US006814350B2

(12) United States Patent
Saegusa et al.

(10) Patent No.: US 6,814,350 B2
(45) Date of Patent: Nov. 9, 2004

(54) PIVOTAL POST PROCESSING TRAY

(75) Inventors: Hiroshi Saegusa, Yamanashi-ken (JP); Yusuke Asao, Yamanashi-ken (JP)

(73) Assignee: Nisca Corporation, Yamanashi-ken (JP)

( * ) Notice: Subject to any disclaimer, the term of this patent is extended or adjusted under 35 U.S.C. 154(b) by 0 days.

(21) Appl. No.: 10/431,519

(22) Filed: May 8, 2003

(65) Prior Publication Data

US 2003/0193125 A1 Oct. 16, 2003

Related U.S. Application Data

(63) Continuation of application No. 09/927,413, filed on Aug. 13, 2001, now Pat. No. 6,685,180.

(30) Foreign Application Priority Data

Aug. 14, 2000 (JP) ..... 2000-245624

(51) Int. Cl.[7] ..... B65H 37/04

(52) U.S. Cl. ..... 270/58.14; 270/58.17; 270/58.12; 270/58.11; 270/58.08; 399/410

(58) Field of Search ..... 270/58.08, 58.11, 270/58.12, 58.14, 58.16, 58.17; 399/410

(56) References Cited

U.S. PATENT DOCUMENTS 4,611,741 A * 9/1986 Wilson ..... 227/99
5,098,074 A * 3/1992 Mandel et al. ..... 270/58.13
5,713,566 A * 2/1998 Coombs et al. ..... 270/58.12
5,984,299 A * 11/1999 Hirota et al. ..... 271/161
6,330,999 B2 * 12/2001 Coombs et al. ..... 270/58.18
6,382,615 B1 * 5/2002 Ishiguro et al. ..... 270/58.12
6,382,616 B1 * 5/2002 Waragai et al. ..... 270/58.12
6,450,934 B1 * 9/2002 Coombs ..... 493/383

FOREIGN PATENT DOCUMENTS

JP 2000086064 A * 3/2000 ..... B65H/33/08
JP 2001072311 A * 3/2001 ..... B65H/31/34
JP 2001097637 A * 4/2001 ..... B65H/37/04
JP 2002080162 A * 3/2002 ..... B65H/31/30

* cited by examiner

*Primary Examiner*—Patrick Mackey
(74) *Attorney, Agent, or Firm*—Manabu Kanesaka

(57) ABSTRACT

An image forming apparatus includes a main body having a sheet ejecting section, a placing tray formed on an upper portion of the main body to receive a sheet ejected from the main body, an image reading device for reading an image disposed above the sheet ejecting section, and a sheet post-processing unit disposed between the image reading device and the placing tray. The post-processing unit includes a supporting device capable of moving between a support position for supporting an upstream side of an ejected sheet in a transfer direction and a retreat position for allowing the sheet to drop onto the placing tray, a post-processing device disposed at a side adjacent to the supporting means for applying post-processing to the sheet supported on the supporting means, and a sheet shift device laterally moving the sheet into and from the post-processing device.

8 Claims, 13 Drawing Sheets

PIVOTAL POST PROCESSING TRAY

CROSS-REFERENCE TO RELATED APPLICATION

This is a continuation application of patent application Ser. No. 09/927,413 filed on Aug. 13, 2001, now U.S. Pat. No. 6,685,180.

BACKGROUND OF THE INVENTION AND RELATED ART STATEMENT

The present invention relates to an image forming apparatus provided with a post-processing device.

As a conventional sheet post-processing device, a sheet post-processing device shown in FIG. 11, which is disclosed in Japanese Patent Publication (KOKAI) No. H1-313261, is known. A sheet post-processing device 100 in FIG. 11 is disposed outside an image forming apparatus main body 101, and a placement tray 102 is disposed outside the sheet post-processing device 100.

In FIG. 11, a sheet S copied in the image forming apparatus main body 101 and fed out by a paper ejection roller 105 is transferred to the sheet post-processing device 100 attached to an outside of the image forming apparatus main body 101. The sheets S transferred to the sheet post-processing device 100 are stapled by a staple unit 103 provided in the sheet post-processing device 100.

The sheets S in which stapling is finished are pushed by an abutting member 104 to be placed on the placement tray 102. The abutting member 104 supports rear ends of the sheets S in a transferring direction to thereby align the rear ends, and when the stapling is finished, the abutting member 104 pushes the rear ends of the sheets S toward the placement tray 102.

The sheet post-processing device 100 is attached to an outside of a side surface of the image forming apparatus main device 101 shown in FIG. 11, and the placement tray 102 is attached to an outside of the sheet post-processing device 100. Therefore, when the sheet post-processing device 100 is installed in the image forming apparatus main body 101, an installation area for the image forming apparatus main body 101 becomes large.

In order to solve the aforementioned problem, there is an image forming apparatus 106 shown in FIG. 12, which is disclosed in Japanese Patent Publication (KOKAI) No. 2000-86076. In this structure, a sheet post-processing device 107 is installed between an image forming apparatus 106 and an image reading device 108. In the image forming apparatus 106 structured as described above, an installation area for the image forming apparatus 106 is reduced by a portion of the sheet post-processing device 107 assembled inside the image forming apparatus main body 106.

However, a placement tray 109 on which the post-processed sheets S are placed remains to be projected outside from a side surface of the image forming apparatus 106. Usually, a size of the placement tray 109 is extremely larger than that of the sheet post-processing device 107, so that if the placement tray 109 remains to be projected, the installation area is not reduced.

Thus, as in a structure shown in FIG. 13 which is disclosed in Japanese Patent Publication (KOKAI) No. H8-277059, there has been known a structure in which a sheet post-processing device 110 is attached above a placement tray 111. The sheet post-processing device 110 includes an internal tray 112. The internal tray 112 is formed of two trays, that is, a first tray 112*a* and a second tray 112*b*.

The internal tray 112 structured as described above opens like a door from a connecting portion between the two trays toward the placement tray 111.

The sheets S are stapled on the internal tray 112, and when the stapling is finished, the internal tray 112 comes to an open condition. When the internal tray 112 is in the open condition, a set of the sheets S falls onto the placement tray 111 by its own weight to be placed on the placement tray 111.

Therefore, since the internal tray 112 for supporting an entire surface of the sheet to which the stapling is applied and the placement tray for placing the stapled sheets are disposed vertically in parallel, the installation area for the post-processing device 110 can be reduced.

However, since the internal tray 112 is opened and closed like a door, the sheet post-processing device 110 is required to have a height sufficient for allowing the internal tray 112 to open. Thus, it is extremely difficult to assemble the sheet post-processing device 110 inside the image forming apparatus. Supposing that the sheet post-processing device 110 is assembled inside the image forming apparatus, when the sheet post-processing device 110 which is considerably high in order to open the internal tray is assembled inside the image forming apparatus, the height of the image forming apparatus is increased.

When the height of the image forming apparatus is increased, in case a document subjected to the image forming is set on the image forming apparatus, a position of setting the document becomes high. If the position of setting the document is high, it becomes difficult to confirm the position of setting. Therefore, there is a problem that this tall image forming apparatus is difficult to use.

Moreover, in order to install the tall sheet post-processing device 110 described above inside the image forming apparatus, a large space is required inside the image forming apparatus. However, in the known image forming apparatuses, since it has been tried to minimize a size thereof as small as possible, the large space described above is normally not formed in the known image forming apparatuses. Therefore, in the known image forming apparatus, especially, there has been a problem that the sheet post-processing device 110 can not be installed inside the image forming apparatus.

Also, as shown in FIG. 14, there has been known a structure disclosed in Japanese Patent Publication (KOKAI) No. 8-143211, in which an auxiliary guide 150 for supporting only a rear end portion of a sheet is disposed above a displacement tray 140 at the highest portion of a plurality of trays to be freely capable of projecting and retracting, such that the sheet is supported by the auxiliary guide 150 and a stapler 155 is moved forward and backward with respect to the sheet in a direction orthogonal to a sheet transferring direction to carry out the stapling process.

However, in this device, it is necessary to move the stapler 155, which is relatively large and heavy, with respect to the sheet, and a motor for moving the stapler 155 also becomes bigger, so that the sheet post-processing device can not be made small. In addition, since the apparatus includes a plurality of trays, as in the aforementioned apparatus of FIG. 11, the sheet post-processing device is attached to the outside of the side surface of the image forming apparatus main body, so that an installation area for the image forming apparatus main body becomes large.

Accordingly, a first object of the invention is to provide an extremely compact sheet post-processing device.

A second object of the invention is to provide an image forming apparatus, in which an installation area for an entire image forming apparatus is not increased even if the sheet post-processing device is attached by selecting the installation site for the compact sheet post-processing device.

Further, a third object of the invention is to provide an image forming apparatus assembled with the sheet post-processing device, which can be easily assembled inside the known image forming apparatus and can be used easily without increasing an installation area of the image forming apparatus.

Further objects and advantages of the invention will be apparent from the following description of the invention.

SUMMARY OF THE INVENTION

To achieve the aforementioned objects, the present invention provides a sheet post-processing device for carrying out post-processing, such as a binding process or punching process, with respect to sheets ejected from an image forming apparatus main body. The sheet post-processing device comprises: a placing tray for placing sheets thereon; supporting means capable of moving between a support position for supporting upstream sides, in the transferring direction, of the sheets ejected above the placing tray, and a retreat position for allowing the supported sheets to drop onto the placing tray; post-processing means fixedly disposed at one end side of the supporting means and applying post-processing to the sheets supported on the supporting means; sheet shift means for shifting the sheets to a position where the sheets are released from the post-processing means; and control means for controlling the sheet shift means to shift the sheets from the post-processing means after the post-processing by the post-processing means is carried out. Also, the control means moves the supporting means to the retreat position.

Accordingly, since the placing tray and the supporting means are overlapped vertically, the space for the supporting means in the sheet transferring direction can be omitted, and there is no need to move the post-processing means, such as a stapler device, resulting in providing an extremely compact sheet post-processing device.

Also, the placing tray includes a first placing section, which supports forward ends of the sheets in the transferring direction, and a second placing section located below the supporting means. The second placing section is lower than the first placing section. Accordingly, the sheets can be extended over the supporting means and the placing tray to be processed, so that the post-processing can be surely carried out.

Also, the present invention provides an image forming apparatus, which comprises a placing tray formed on an upper surface of an image forming apparatus main body and placing sheets ejected from the image forming apparatus thereon; an ejecting section projected above the placing tray and disposed to be spaced away from the placing tray, in which the sheet ejecting section includes a sheet ejection port; and a sheet post-processing device including a unit formed of supporting means and post-processing means. The supporting means is provided between the placing tray and the sheet ejection port, and is capable of moving between a support position for supporting upstream sides, in the transferring direction, of the ejected sheets, and a retreat position for allowing the supported sheets to drop onto the placing tray. The post-processing means is disposed to be adjacent to one end side of the supporting means, and provided for applying post-processing to the sheets supported on the supporting means.

Further, the image forming apparatus described above further includes an image reading device for reading an image, which is disposed above the placing tray on the upper surface of the image forming apparatus main body and the ejecting section. The sheet post-processing device formed of the unit is disposed between the image reading device and the placing tray and located adjacent to the sheet ejection port.

Accordingly, there is no need to increase an installation area for the entire image forming apparatus. Even in case of the known image forming apparatus, the sheet post-processing device can be easily assembled therewith, and the image forming apparatus assembled with the sheet post-processing device, which is easy to use, can be provided without increasing the installation area for the image forming apparatus.

BRIEF DESCRIPTION OF THE DRAWINGS

FIG. 5(*b*) is a schematic view showing a state when the sheets are being aligned by the alignment plates;

FIG. 5(*c*) is a schematic view showing a state when the sheets are aligned by the alignment plates;

FIG. 5(*d*) is a schematic view showing a state when the sheets are pushed out from a processing section by the alignment plates;

FIG. 6(*b*) is a schematic view showing a state when the sheets in the first embodiment are being released;

FIG. 6(*c*) is a schematic view showing a state after the sheets in the first embodiment are released;

DETAILED DESCRIPTION OF PREFERRED EMBODIMENTS

Figure 1:
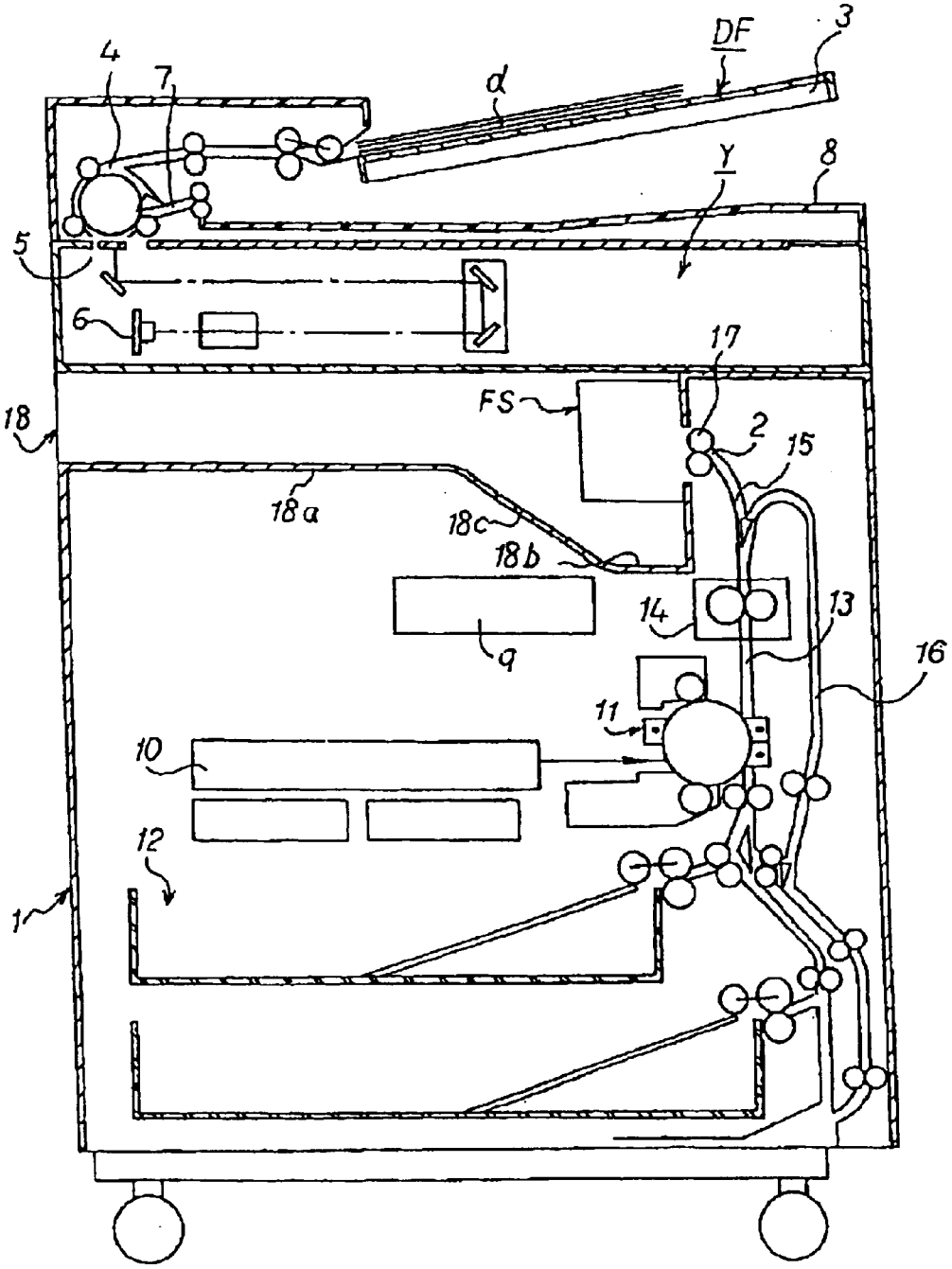
FIG. 1 is a schematic view showing an entire structure of a first embodiment.

FIGS. 1 to 6(*c*) show a first embodiment of the invention, and FIG. 1 is a view showing an entire structure of an image forming apparatus 1 which is provided with a sheet post-processing device FS, an automatic document feeder DF, and an image reading device Y.

The image reading device Y and the automatic document feeder DF are mounted above the image forming apparatus 1, and a paper ejection port 2 for ejecting a sheet S on which the image is formed is provided in a space between the image forming apparatus 1 and the image reading device Y. The sheet post-processing device FS is connected to the paper ejection port 2.

When a document d is placed on a document table 3 of the automatic document feeder DF, the document d is transferred to a document supply path 4 by respective transfer rollers, and reaches a reading section 5. An image of the document d which has reached the reading section 5 is read by an image reading element or sensor 6 of the image reading device Y.

The document d, which has passed through the reading section 5 such that the image thereof is read, is transferred from a document ejection path 7 to a document return tray 8. Here, in case there are images on both surfaces of the document d, the document d once transferred to the document return tray 8 is reversely sent to the document supply path 4 again. Then, the document d is reversed, and the sensor 6 reads an image on the surface opposite to the surface on which the image is read in the aforementioned process.

The image read by the sensor 6 as described above is sent as an analog signal to an image processing section 9. After the image processing section 9, which has received the image signal, carries out analog processing, analog-to-digital conversion, shading correction, image compression process and the like, the processed image signal is sent to an image writing section 10.

In the image writing section 10, which has received the processed image signal, the image signal as an output light from a semiconductor laser is irradiated to a photosensitive drum of an image forming section 11, to thereby develop the image on the drum.

In the image forming section 11, the image is transferred to the sheet S. The sheets S are supplied one by one by respective rollers from a cassette paper supply section 12 to a paper supply path 13. The image forming section 11 described above is disposed in the paper supply path 13, and the image forming section 11 transfers the image of the document d developed on the photosensitive drum to the sheet S passing through the paper supply path 13.

The sheet S on which the image is transferred as described above is sent to a further downstream side of the paper supply path 13. In the downstream side of the image forming section 11 in the paper supply path 13, there is provided a fixing section 14 which fixes the image transferred in the image forming section 11 to the sheet S. When the image is fixed in the fixing section 14 as described above, the sheet S is sent further downstream, and ejected from a paper ejection port 2 through a paper ejection path 15. The paper ejection port 2 is provided with rollers 17, and the sheet S is ejected by the rollers 17.

Incidentally, in case the image is formed on both sides of the sheet S, instead of sending the sheet S from the fixing section 14 to the paper ejection path 15, the sheet S is sent from the fixing section 14 to a duplex path 16. In the duplex path 16, the sheet S sent to the duplex path 16 is placed such that a surface on which an image is not formed faces the image forming section 11 side, and the sheet S is sent to the paper supply path 13 again. Then, the sheet S in which the image is formed on both sides is ejected to the paper ejection port 2 through the paper ejection path 15 as in the one-side image forming.

The paper ejection port 2 is continuously connected to the sheet post-processing device FS, and the image-formed sheet S is sent from the paper ejection port 2 to the sheet post-processing device FS. Then, post-processing by the staple is carried out in the sheet post-processing device FS, and when the post-processing is finished, the sheets S are stored on a placing tray 18.

The placing tray 18 is formed of a first placing section 18*a* located at substantially the same height as the paper ejection port 2, and a second placing section 18*b* which is provided at an upper stream side than the first placing section 18*a* and located at a position lower than the first placing section 18*a*. The first placing section 18*a* extends to the second placing section 18*b* through a slope 18*c*.

Figure 2:
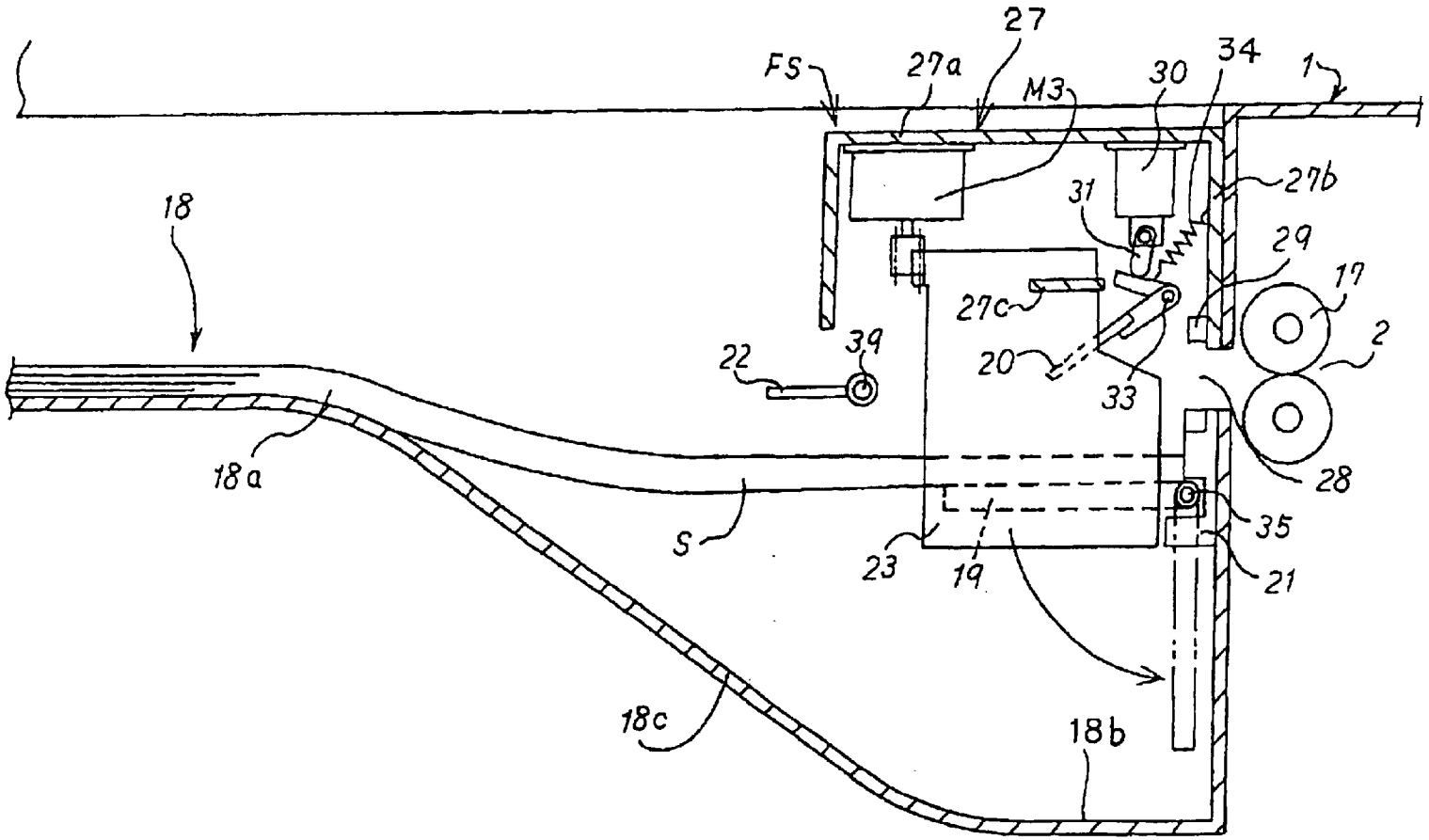
FIG. 2 is an enlarged schematic view showing a main part of the first embodiment.

Next, the sheet post-processing device FS will be explained in detail with reference to FIGS. 2 through 6(*c*). FIG. 2 is an enlarged view of the sheet post-processing device FS shown in FIG. 1.

Here, in order to specify directions of the sheet S, a side of the sheet S, which is parallel to a direction of transferring the sheet S, is defined as a transferring direction, and a side of the sheet S, which is orthogonal to the transferring direction, is defined as a width direction. Also, a case of using a staple unit is explained as a post-processing unit for the sheets S.

The sheet post-processing device FS includes a support plate 19 for supporting a rear end of the sheet S in a transferring direction; arms 20 which push the transferred sheet S onto the support plate 19; paddles 22 which make the rear end of the sheet S placed on the support plate 19 to abut against a regulating plate 21 to thereby align the rear end of the sheet S; alignment plates 23*a* and 23*b* for aligning the width direction of the sheet S; a staple unit 26 which carries out post-processing with respect to the aligned sheets S; and a cover 27 for covering these members.

In this first embodiment, the support plate 19 has a function of a release mechanism for releasing the sheet S, which will be explained later. Also, in the sheet post-processing device FS, a controller, not shown, is provided, and first, second, third and fourth motors M1, M2, M3 and M4, described later, are controlled by the controller.

In the structure described above, steps after the sheet S is ejected from the image forming apparatus 1 and is sent to the sheet post-processing device FS, in which the sheets S are post-processed after several sheets S are stacked, until the processed sheets S are placed on the placing tray 18, are explained in detail.

As shown in FIG. 2, the cover 27 is formed of a ceiling surface 27*a* and side surfaces 27*b* covering four sides thereof, and a bottom of the cover 27 is opened. Also, the cover 27 is provided with a guide section 27*c* which is parallel to the ceiling surface 27*a*.

An inlet 28 for the sheet S is formed on the side surface 27*b* of the cover 27, which contacts the image forming apparatus 1, and the sheet post-processing device FS is assembled with the image forming apparatus 1 such that the inlet 28 is continuously connected to the paper ejection port 2 of the image forming apparatus 1. Therefore, the sheet S ejected from the paper ejection port 2 of the image forming apparatus 1 is sent to the inlet 28 of the sheet post-processing device FS by the rollers 17.

At first, a first sheet S is transferred to the sheet post-processing device FS as described above. An inlet sensor 29 is disposed at the inlet 28 of the sheet post-processing device FS, and checks that the sheet S is transferred into the sheet post-processing device FS. Then, the sheet S is entirely sent by the rollers 17, and when the inlet sensor 29 checks the rear end of the sheet S, the inlet sensor 29 sends a signal to a solenoid 30.

Figure 3:
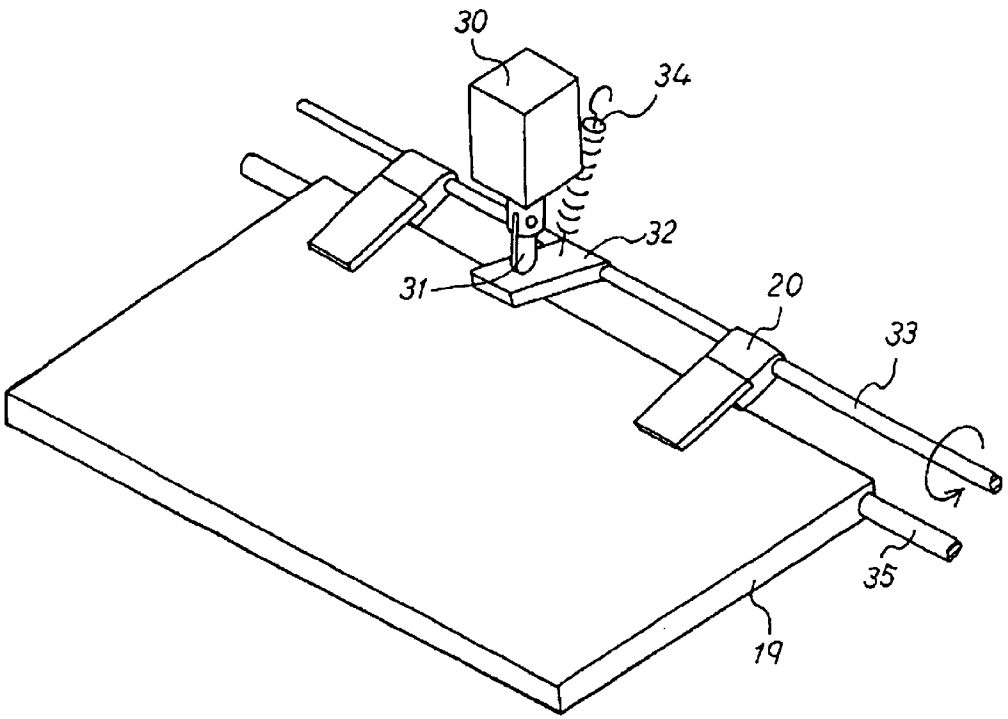
FIG. 3 is an enlarged schematic view showing a portion inside a sheet post-processing device of the first embodiment.

The solenoid 30 is disposed at the ceiling surface 27*a* of the cover, and as shown in FIG. 3, the solenoid 30 is connected to a rotating lever 32 through a solenoid shaft 31. One side of the rotating lever 32 is fixed to a shaft 33, and the arms 20 are fixed to the shaft 33. In other words, the rotating lever 32 and the arms 20 are connected through the shaft 33.

Also, as described above, the solenoid shaft 31 and the rotating lever 32 are connected to each other, and a connecting position thereof is a position close to a side opposite to a side to which the shaft 31 is fixed. One end of a spring 34 is fixed to the connection portion between the solenoid shaft 31 and the rotating lever 32, and the other end of the spring 34 is fixed to the side surface 27*b* of the cover in the image forming apparatus 1 side.

In the structure described above, when a signal notifying that the rear end of the sheet S passes through the inlet is sent from the inlet sensor 29 to the solenoid 30, the solenoid 30 is turned on, and the solenoid shaft 31 is extended. When the solenoid shaft 31 is extended, the rotating lever 32 is pushed down toward a downside in FIG. 3 while extending the spring 34. When the rotating lever 32 is pushed down, the shaft 33 connected thereto is rotated in an arrow direction in FIG. 3. When the shaft 33 is rotated, accordingly, the arms 20 are rotated in the arrow direction in FIG. 3.

By the rotation of the arms 20 as described above, the rear end portion of the sheet S transferred to the sheet post-processing device FS is dropped downwardly in FIG. 3. The rear end portion of the sheet S dropped downwardly is placed on the support plate 19.

The support plate 19 is located below the arms 20 and at a position down from the inlet 28, and the support plate 19 has a size for supporting only the rear end portion of the sheet S. Also, the support plate 19 is formed freely rotatably at a shaft 35 supported at the side surface 27*b* of the cover. A detailed method of rotating the support plate will be explained later.

As described above, by dropping the sheet S by the arms 20, the rear end of the sheet S is surely placed on the support plate 19. Since the support plate 19 has the size for supporting only the rear end of the sheet S as described above, if the arms 20 do not flaps off the sheet S, the sheet S transferred by the rollers 17 might pass through the support plate 19.

As described above, only the rear end of the sheet S is placed on the support plate 19, and a forward end portion of the sheet S passes through an inside of the sheet post-processing device FS to be supported by the first placing section 18*a* of the placing tray 18. Namely, the sheet S is supported such that the sheet S extends over the support plate 19 and the first placing section 18*a*.

When the arm 20 flaps off the rear end of the sheet S onto the support plate 19, the extended spring 34 is returned to an initial position. When the spring 34 is returned to the initial position, the shaft 33 is rotated in a direction reverse to the arrow direction in FIG. 3, to thereby return the arms 20 to the initial position.

When the sheet S is placed on the support plate 19, the paddles 22 shown in FIG. 2 are rotated to push back the sheet S in a direction reverse to the forwarding direction. By pushing back the sheet S, the rear end of the sheet S is allowed to abut against the regulating plate 21, to thereby align the rear end of the sheet S.

Figure 4:
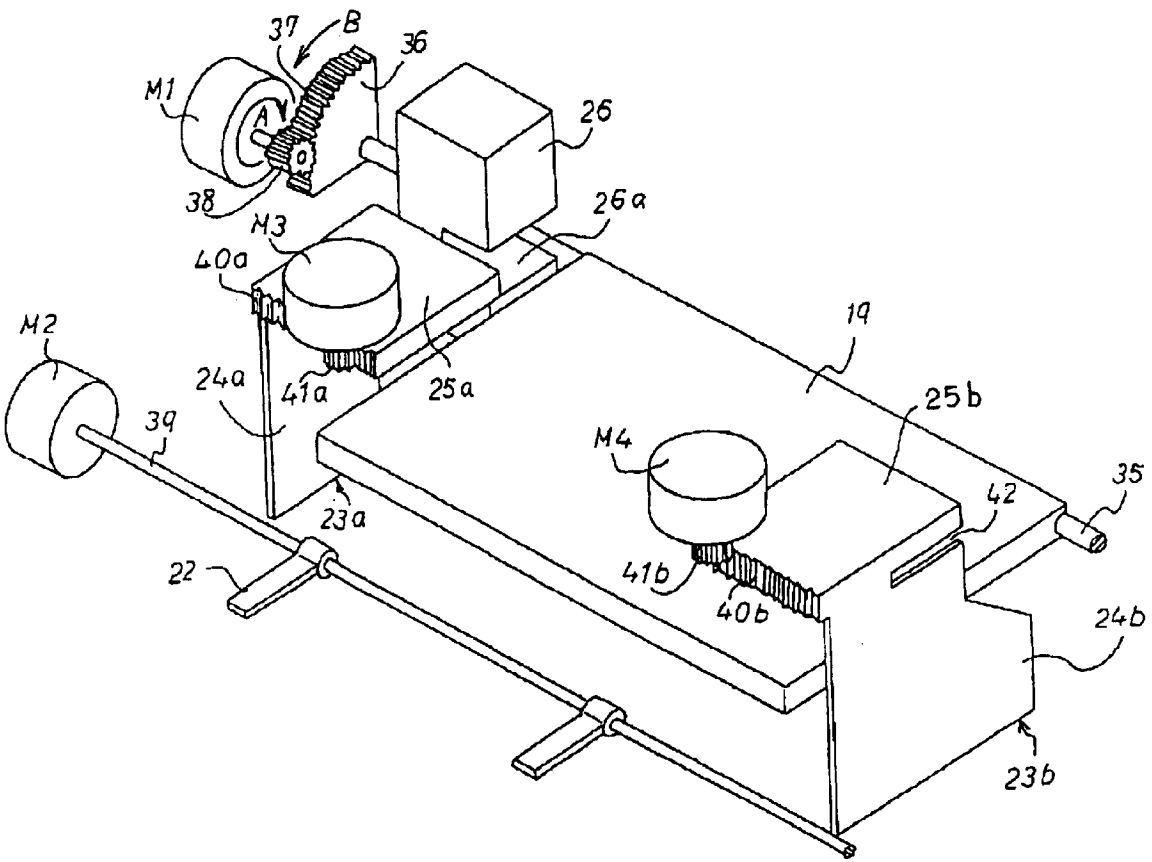
FIG. 4 is an enlarged schematic view showing a portion inside the sheet post-processing device of the first embodiment.
Figure 5A:
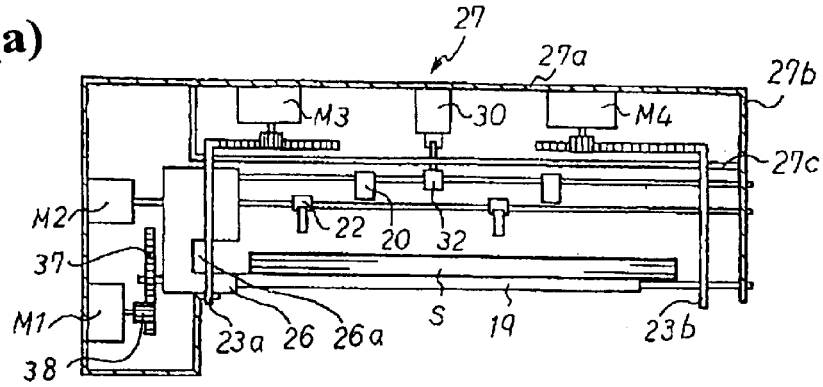
FIG. 5(*a*) is a schematic view showing a state before sheets are aligned by alignment plates.
Figure 5B:
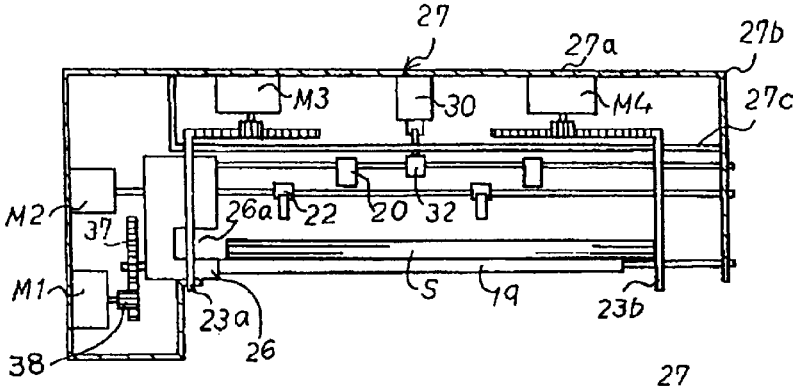
Figure 5C:
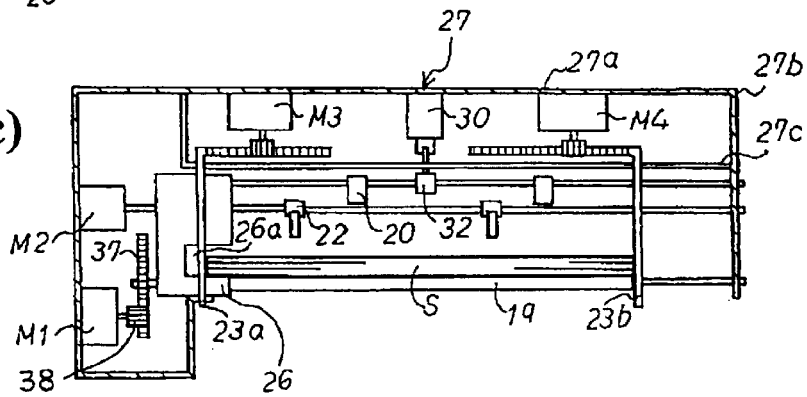
Figure 5D:
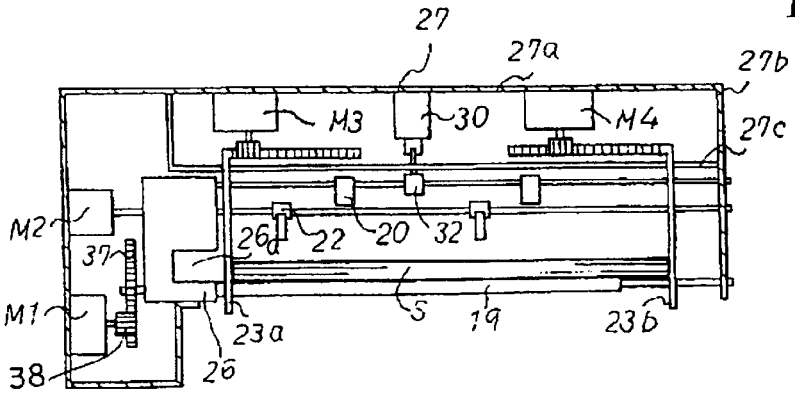

Also, as shown in FIG. 4, the paddles 22 are connected to a shaft 39, and the paddles 22 are rotated by the rotation of the shaft 39. The shaft 39 is connected to the second motor M2, and the motor M2 is disposed at the side surface 27*b* of the cover.

When the rear end of the first sheet S is aligned as described above, the second sheet S is transferred from the image forming apparatus 1. The transferred second sheet S is disposed on the first sheet S placed on the support plate 19, and a rear end of the second sheet S is aligned by the arms 20.

As described above, a predetermined number of sheets S is placed on the support plate 19. When the predetermined number of the sheets S is placed on the support plate 19 and the rear ends of the sheets S are aligned, subsequently, the alignment plates 23*a* and 23*b*, which are provided at both sides in the width direction of the sheets S, align the width directions of the sheets S.

Namely, the alignment plates 23*a* and 23*b* are respectively formed of alignment sections 24*a* and 24*b* perpendicularly colliding with the side surfaces in the width direction of the sheets S, and rack-formed sections 25*a* and 25*b* which are orthogonal to the alignment sections 24*a* and 24*b* and disposed at upper portions of the alignment sections 24*a* and 24*b*. Racks 40*a* and 40*b* are formed on side surfaces of the rack-formed sections 25*a* and 25*b*, and pinions 41*a* and 41*b* to be engaged with the racks 40*a* and 40*b* are provided. The pinion 41*a* is rotated by the third motor M3, and the pinion 41*b* is rotated by the fourth motor M4. The third motor M3 and the fourth motor M4 are fixed to the ceiling surface 27*a* of the cover.

Also, slide holes 42 are respectively formed in the alignment sections 24*a* and 24*b*, and the guide 27*c* is inserted into the slide holes 42.

In this structure, after the paddles 22 align the rear ends of the sheets S, the fourth motor M4 is rotated. When the fourth motor M4 is rotated, the alignment plate 23*b* allows the sheets S to abut against the alignment plate 23*a*, to thereby align the width direction of the sheets S.

Movements of the alignment plate 23*b* at this time are shown in FIGS. 5(*a*) to 5(*d*). FIG. 5(*a*) shows an initial state before the alignment plate 23*b* is moved. From this state, when the fourth motor M4 is rotated so that the pinion 41*b* is rotated, the alignment plate 23*b* is moved in a direction toward the alignment plate 23*a*, that is, in a leftward direction in FIG. 5(*a*). When the alignment plate 23*b* is moved, the alignment plate 23*b* abuts against the sheets S as shown in FIG. 5(*b*). The alignment plate 23*b* which abuts against the sheets S is further moved toward the left in the figure, and pushes the sheets S against the alignment plate 23*a*. By pushing the sheets S against the alignment plate 23*a*, the width directions of the sheets S are aligned as shown in FIG. 5(*c*).

Also, at this time, while the width direction of the sheets S is aligned, the rear end portions of the sheets S are inserted into the processing section 26*a* of the staple unit 26 as shown in FIG. 5(*c*).

Although not shown in the figures, the staple unit 26 includes staples and staple driving means for driving the staples, and the staple is driven to the sheets S at the processing section 26*a*. Therefore, as described above, the staple driving means, not shown, drives the staple to the sheets S guided to the processing section 26*a* by the alignment plates 23*a* and 23*b*, to thereby carry out the post-processing.

At this time, the position where the staple is driven is the rear ends of the sheets S, and the rear ends of the sheets are supported by the support plate 19. Since the rear ends to be stapled are supported by the support plate 19, a stability in stapling can be maintained as compared with a case of supporting the other portions of the sheets. Namely, without displacement of the sheet S, the staple can be surely provided to the sheets S.

When the sheets S are post-processed as described above, the fourth motor M4 is rotated reversely to the rotation at the time of aligning the sheets S, such that the alignment plate 23*b* is moved toward a right side as shown in FIG. 5(*d*). Concurrently with the movement of the alignment plate 23*b* toward the right side, the third motor M3 is rotated in the same direction as that of the fourth motor M4, to thereby move the alignment plate 23*a* toward the right side. By moving the alignment plates 23*a* and 23*b* toward the right side in FIG. 5(*d*), the sheets S are moved to the right side, so that the post-processed sheets S are disengaged from the processing section 26*a* of the staple unit 26. When the post-processed sheets S are completely disengaged from the processing section 26*a*, the first motor M2 shown in FIG. 4 is rotated in the direction of an arrow A.

The first motor M1 is provided with a pinion gear 38, and it is structured that a gear 37 of a fan-shaped member 36 is engaged with the pinion gear 38. Namely, the gear 37 is formed at an arc portion of the fan-shaped member 36, and the gear 37 is engaged with the pinion gear 38. When the first motor M1 is rotated in the direction of the arrow A in FIG. 4, the pinion gear 38 is also rotated in the direction of the arrow A. Then, by engaging the pinion gear 38, the fan-shaped member 36 is rotated in a direction of an arrow B in FIG. 4. When the fan-shaped member 36 is rotated, the shaft 35 and the support plate 19 are integrally rotated. Incidentally, the first motor M1 is fixed to the side surface 27*b* of the cover.

Figure 6A:
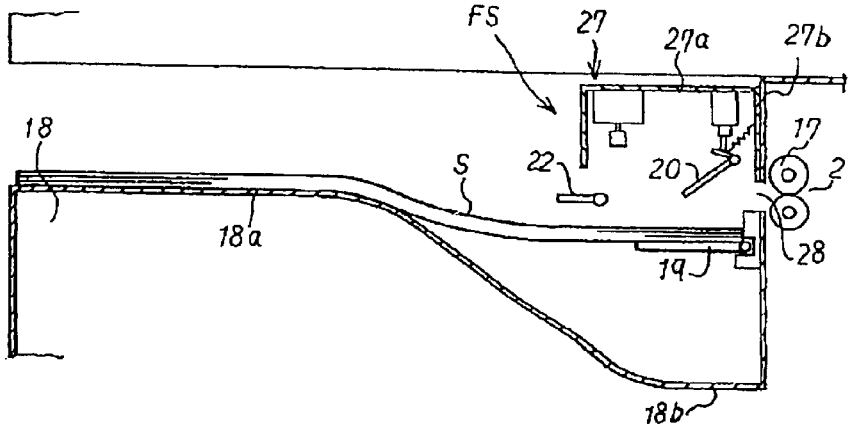
FIG. 6(*a*) is a schematic view showing an initial position before the sheets in the first embodiment are released.
Figure 6B:
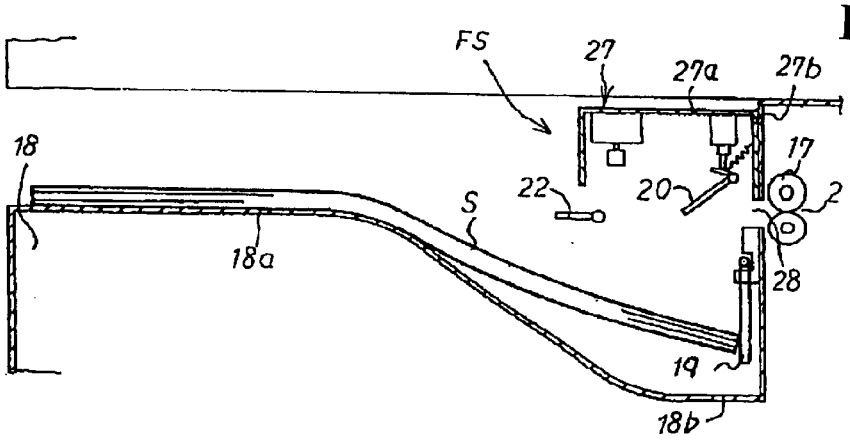
Figure 6C:
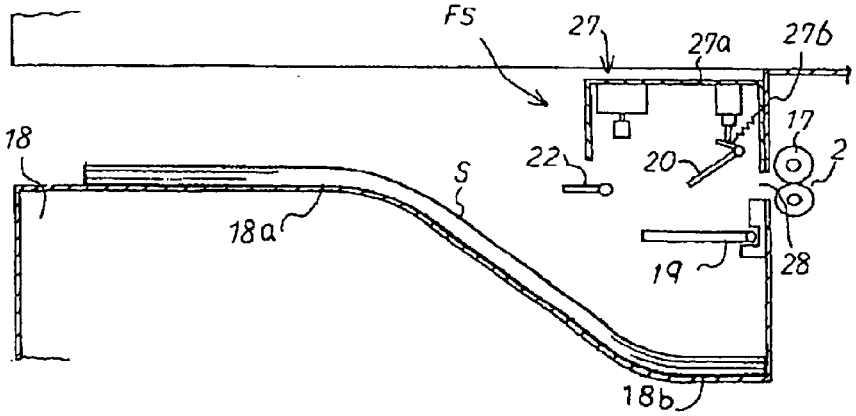

When the support plate 19 is rotated as described above, the sheets S supported by the support plate 19 are dropped onto the placing tray 18. Namely, the support plate 19 is rotated from the initial state in which the rear ends of the sheets S are supported by the support plate 19 as shown in FIG. 6(*a*), and the sheets S placed on the support plate 19 are dropped down as shown in FIG. 6(*b*). The dropped sheets S are placed on the placing tray 18 as shown in FIG. 6(*c*). At this time, the rear end portions of the post-processed sheets S are placed on the second placing section 18*b* of the placing tray 18, and the forward end portions of the sheets S are placed on the first placing section 18*a* as shown in FIG. 6(*c*).

When the support plate 19 is rotated such that the sheets S are placed on the placing tray 18 as described above, the first motor M1 is rotated reversely to the direction of the arrow A in FIG. 4. In accordance therewith, the fan-shaped member 36 is rotated reversely to the direction of the arrow B, and the support plate 19 is returned to the initial position.

As described above, while the support plate 19 supports the transferred sheets S, the support plate 19 has a releasing function for dropping and releasing the post-processed sheets S.

According to the first embodiment described above, by rotating the support plate 19, the post-processed sheets S can be dropped right under the support plate 19. Furthermore, since the placing tray 18 is provided under the support plate 19, by merely rotating the support plate 19, the sheets S can be placed on the placing tray 18. Therefore, it is not necessary to provide the placing tray 18 outside the image forming apparatus 1, so that a floor space for installation can be reduced.

Also, since the support plate 19 supports only the rear end portions of the sheets S transferred from the image forming apparatus 1 such that the forward end portions of the sheets are supported by the placing tray 18, a size of the support plate 19 in the transferring direction can be reduced. By reducing the size of the support plate 19, a space for rotating the same can be small. Namely, the entire sheet post-processing device FS can be made compact. Therefore, the compact sheet post-processing device FS can be easily assembled with the image forming apparatus, and there is no such a problem that the image forming apparatus 1 becomes tall.

Further, in the known image forming apparatus, even if the image reading device Y and the automatic document feeder DF are disposed above the image forming apparatus 1, the sheet post-processing device FS can be installed in a space between the image forming apparatus 1 and the image reading device Y.

Incidentally, although the staple unit is adopted as the sheet post-processing unit in this embodiment, it is needless to say that other post-processing unit, such as a punching, can be used. Also, although the first motor M1 is used for rotating the support plate 19 in the embodiment, other driving device, such as a solenoid, can be used instead. Further, though the solenoid is used for rotating the arm 20, other driving device can be used instead.

Incidentally, the image forming apparatus 1 has a post-processing execution mode, in which stapling or punching is carried out to each set of a predetermined number of sheets by using the sheet post-processing device to provide a required number of post-processed sets of the sheets, and a straight ejection mode, in which the sheets are directly stacked and placed onto the placing tray 18 without carrying out the post-processing described above. The device of the embodiment can be easily adapted to both of these modes.

Namely, when an instruction of carrying out the post-processing with respect to the ejection sheet is issued, as explained above, a predetermined number of the sheets is supported by the support plate 19. This state of the support plate 19 constitutes a support state, which is shown in FIG. 6(*a*). Then, after the predetermined number of the sheets is supported by the support plate 19 and the post-processing is carried out, the support plate 19 becomes a release state in which the sheets S are dropped and released on the placing tray 18 as shown in FIG. 6(*b*).

On the other hand, in case an instruction of carrying out the straight ejection mode is issued, as shown in FIG. 6(*b*), the support plate 19 is held at the position for allowing the sheets S to be dropped and released without supporting the sheets S. Namely, the support plate 19 is in the release state shown in FIG. 6(*b*) from the beginning without taking the support state shown in FIG. 6(*a*).

Incidentally, the initial position or state of the support plate 19 before setting of the respective modes can be either the support state or the release state. When the support plate 19 is in the support state as the initial state, after setting of carrying out the straight ejection mode, the support plate 19 can be moved to the position of FIG. 6(*b*) as the release state. On the contrary, when the initial state of the support plate 19 is set at the position of FIG. 6(*b*) as the release state, after setting the post-processing execution mode, the support plate 19 can be moved to the support state in which the sheets are supported. By structuring the device as described above, the device can be easily adapted to any of the post-processing execution mode or the straight ejection mode.

Figure 7:
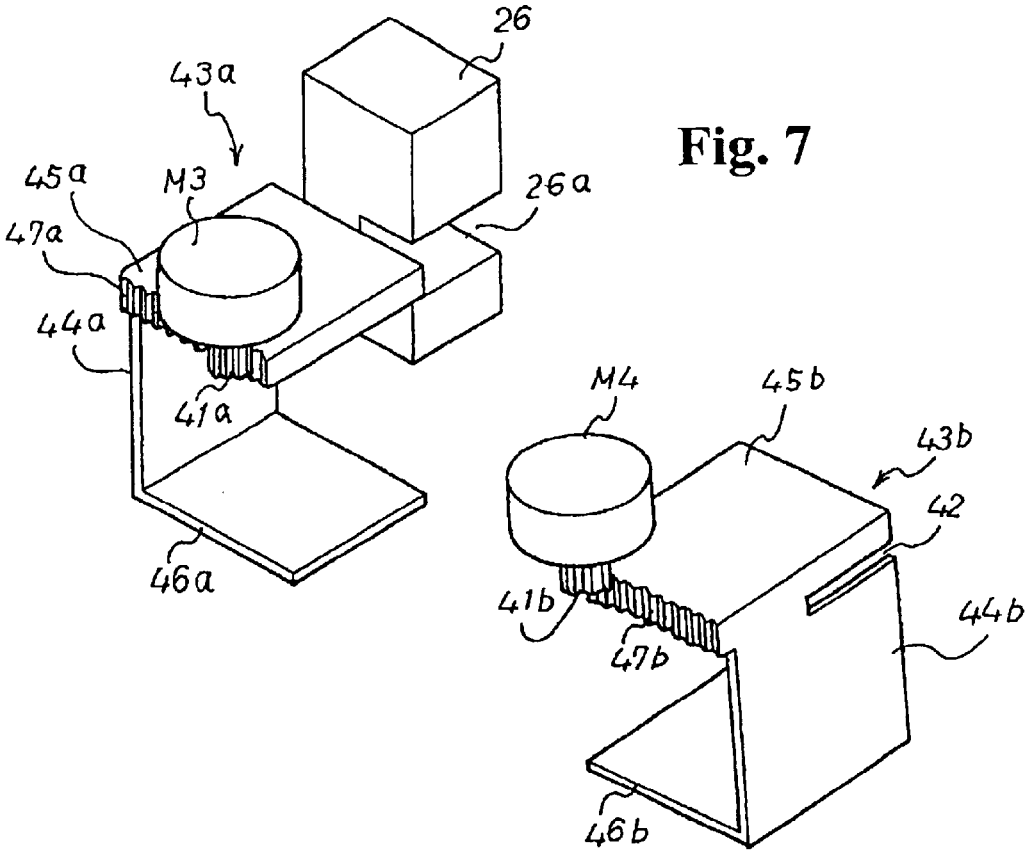
FIG. 7 is an enlarged schematic view showing an inside of a sheet post-processing device of a second embodiment of the invention.

FIG. 7 shows a second embodiment of the invention, wherein means for releasing the post-processed sheets and the alignment plates are integrally formed. The constituents other than this character are the same as in the first embodiment, so that the same references as those in the first embodiment are used to designate the constituents, to thereby omit the detailed explanations therefor.

In the second embodiment, the alignment sections 44*a* and 44*b* and rack-formed sections 45*a* and 45*b* are respectively formed in the alignment plates 43*a* and 43*b*, and the alignment plates 43*a* and 43*b* are further provided with support sections 46*a* and 46*b*. The rack-formed sections 45*a* and 45*b* are disposed respectively at upper portions of the alignment sections 44*a* and 44*b*, and the support sections 46*a* and 46*b* are disposed respectively at lower portions of the alignment sections 44*a* and 44*b* such that the alignment plates 43*a* and 43*b* have U-shaped forms.

In addition, racks 47*a* and 47*b* are formed in the rack-formed sections 45*a* and 45*b*, such that racks 47*a* and 47*b* engage the pinions 41*a* and 41*b*. The pinion 41*a* is rotated by the third motor M3, and the pinion 41*b* is rotated by the fourth motor M4.

In the second embodiment structured as described above, the first sheet S is ejected from the paper ejection port 2 of the image forming apparatus 1, and the sheet S is sent from the inlet 28 of the sheet post-processing device FS into the sheet post-processing device FS. The sheet S sent into the sheet post-processing device FS is dropped off by the arms 20, so that the rear end of the sheet S is placed on the support sections 46*a* and 46*b*. At this time, the forward end of the sheet S is placed on the first placing section 18*a* of the placing tray 18. When the sheet S is placed on the support sections 46*a* and 46*b* as described above, the paddles 22 push the rear end of the sheet S against the regulating plate 21, to thereby align the rear end of the sheet S.

Then, the second sheet S and the third sheet S are successively transferred in order from the image forming apparatus 1, and as in the first sheet S, these sheets are respectively placed on the support sections 46*a* and 46*b* to thereby align the rear ends thereof.

When a predetermined number of sheets S is placed on the support sections 46*a* and 46*b* as described above, the fourth motor M4 is rotated, and the alignment plate 43*b* is moved in a direction toward the alignment plate 43*a*. In accordance with the movement of the alignment plate 43*b*, the sheets S supported by the support section 46*b* of the alignment plate 43*b* are moved. As described above, the alignment plate 43*b* and the sheets S are moved in the direction toward the alignment plate 43*a*, and the sheets S are aligned by the alignment section 44*a* of the alignment plate 43*a* and the alignment section 44*b* of the alignment plate 43*b*.

When the sheets S are aligned by allowing the sheets S to abut against the alignment plate 43*a*, the sheets S are inserted into the processing section 26*a* of the staple unit 26. When the sheets S are inserted into the processing section 26 as described above, the sheets S are stapled by the staple unit 26. When the sheets S are post-processed by stapling, the third motor M3 and the fourth motor M4 are rotated, so that the alignment plates 43*a* and 43*b* are simultaneously moved in a direction toward a right lower side in FIG. 7. Thus, the post-processed sheets S are disengaged from the processing section 26*a*.

When the post-processed sheets S are completely disengaged from the processing section 26*a*, only the fourth motor M4 is rotated, and the alignment plate 43*b* is further moved in the direction toward the right lower side in FIG. 7. By moving only the alignment plate 43*b* as described above, the sheets S supported by the support sections 46*a* and 46*b* are disengaged from the support sections 46*a* and 46*b*. The sheets S disengaged from the support sections 46*a* and 46*b* are placed on the placing tray 18 disposed below the sheet post-processing device FS.

As described above, while the support sections 46*a* and 46*b* support the transferred sheets S, the support sections 46*a* and 46*b* have a releasing mechanism for releasing the post-processed sheets S.

According to the second embodiment described above, by merely increasing a distance between the alignment plate 43*a* and the alignment plate 43*b*, the sheets S in which the post-processing is completed can be released onto the placing tray 18. Namely, since there is no need to drop the sheets S by rotating the support sections 46*a* and 46*b*, a space for rotating the support sections 46*a* and 46*b* is not required. Therefore, the sheet post-processing device FS can be made much smaller.

This compact sheet post-processing device FS can be assembled with the known image forming apparatus which is not provided with a large space for installing the sheet post-processing device therein.

Incidentally, although the sheets S are pushed from one direction, that is, from the alignment plate 43*b* so as not to move the alignment plate 43*a* in case of aligning the sheets S by the alignment plates 43*a* and 43*b* in the second embodiment, it can be arranged such that both the alignment plates 43*a* and 43*b* are moved to align the sheets S. Namely, in case of aligning the sheets S, the alignment plate 43*a* is moved in a direction toward the alignment plate 43*b*, and the alignment plate 43*b* is moved in a direction toward the alignment plate 43*a*, such that the alignment plates may be moved from both directions. In this case, after the sheets S are aligned, while the condition of aligning the sheets S is maintained, the alignment plates 43*a* and 43*b* are moved in the direction toward the staple unit 26, so that the sheets S are inserted into the processing section 26*a*.

Also, when the post-processed sheets S are released from the alignment plates 43*a* and 43*b*, only the alignment plate 43*b* is moved away from the alignment plate 43*a* and the alignment plate 43*a* does not move. However, it can be structured that the alignment plate 43*a* is also moved. Namely, both the alignment plate 43*a* and alignment plate 43*b* can be moved away from each other, so as to release the post-processed sheets S.

Figure 8:
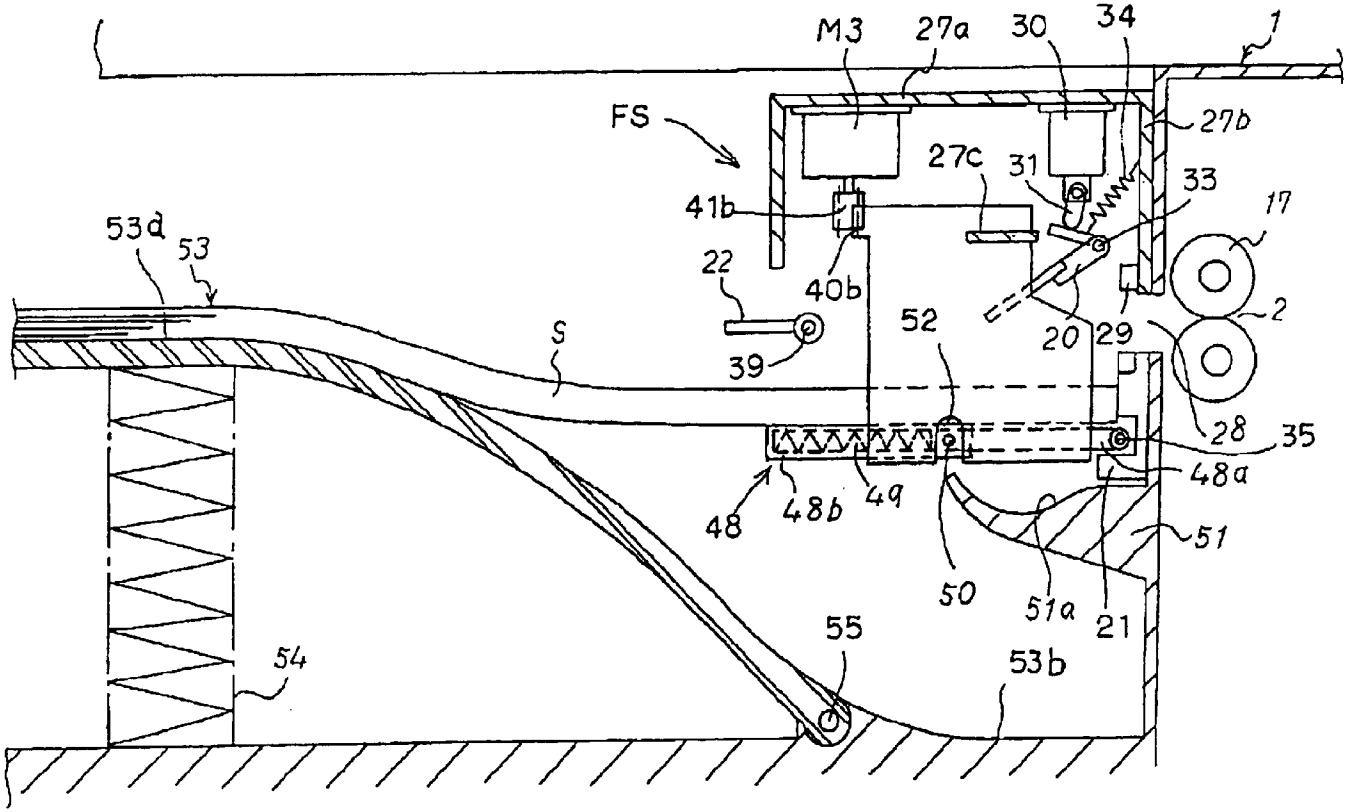
FIG. 8 is a schematic view showing a third embodiment of the invention.
Figure 9:
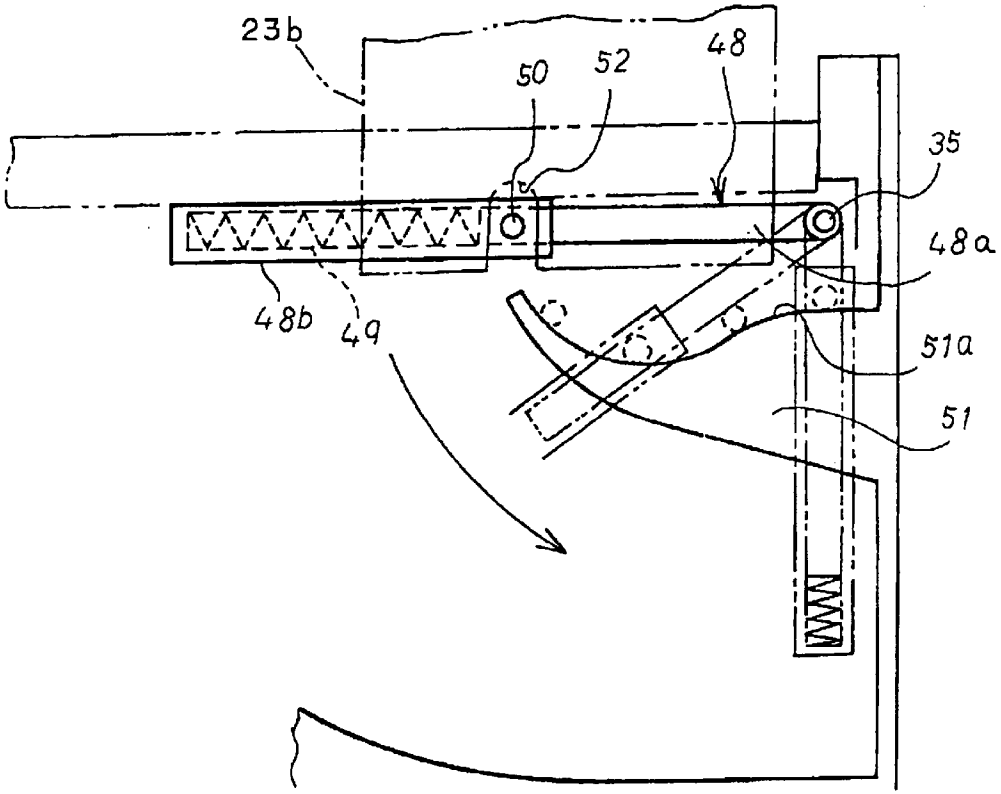
FIG. 9 is an enlarged schematic view showing an inside of a sheet post-processing device of the third embodiment.

FIGS. 8 and 9 show a third embodiment, wherein the support plate for supporting the sheets constitutes the means for releasing the post-processed sheets, and the support plate is extended and contracted. The structures other than this are the same as in the first embodiment. The constituents which are the same as those in the first embodiment are designated by the same references, and detailed explanations therefor are omitted herewith.

In the third embodiment, the sheet post-processing device FS is provided with a support plate 48 for supporting the sheets S transferred from the image forming apparatus 1. The support plate 48 is formed of a base 48*a* and an expanding and contracting section 48*b*, and the base 48*a* is rotated by the rotation of the shaft 35.

The expanding and contracting section 48*b* has a cylindrical shape including a hollow inside, and a hollow portion thereof is provided with a spring 49. Also, the base 48*a* is inserted into the cylindrical expanding and contracting section 48*b*, so that the expanding and contracting section 48*b* is movable along the base 48*a* through the spring 49.

Further, a projection 50 is formed in the expanding and contracting section 48*b*, and when the projection 50 is moved, the expanding and contracting section 48*b* is accordingly moved along the base 48*a* while contracting the spring 49. The support plate 48 shown in FIGS. 8 and 9 is in the initial state, in which the expanding and contracting section 48*b* is extended to the maximum.

Also, in the third embodiment, below the shaft 35, a cam 51 is formed at the side surface 27*b* of the cover 27 of the sheet post-processing device FS at the image forming apparatus 1 side. Thus, when the support plate 48 is rotated, the projection 50 formed at the expanding and contracting section 48*b* is moved along an outline curve 51*a* formed at the cam 51.

When the support plate 48 is rotated from the initial state, the projection 50 is moved along the outline curve 51*a* in accordance with the rotation, such that the projection 50 is moved to get closer to the shaft 35. When the projection 50 is moved to get closer to the shaft 35, the expanding and contracting section 48*b* is also moved to get closer to the shaft 35. Namely, while the expanding and contracting section 48*b* contracts the spring 49, the expanding and contracting section 48*b* moves such that an entire length of the support plate 48 is shortened. Then, when the support plate 48 is rotated for approximately 90 degrees from the initial state, the support plate 48 has the shortest length.

Also, when the support plate 48 is in the initial state, in order to prevent the projection 50 from contacting the alignment plate 23*b*, a portion of the alignment plate 23*b*, which is located at a position corresponding to the projection 50, is notched to form a notched portion 52.

Further, in this embodiment, a first placing section 53*a* of a placing tray 53 is formed of a member which is separated from a second placing section 53*b*, and by contracting a spring 54, the first placing section 53*a* is lowered. The first placing section 53*a* is disposed to be rotatable around a shaft 55.

In this structure, when the sheet S is transferred to the sheet post-processing device FS from the image forming apparatus 1, the sheet S is placed onto the support plate 48 by the arms 20. When a predetermined number of the sheets S is placed on the support plate 48, the rear ends of the sheets S in the transferring direction are aligned by the paddles 22, and the width direction of the sheets S is aligned by the alignment plates 23*a* and 23*b*. Then, the aligned sheets S are stapled by the staple unit 26. When the sheets S are stapled, the first motor M1 is rotated to rotate the shaft 35, resulting in rotating the support plate 48.

When the support plate 48 is rotated and moved in an arrow direction in FIG. 9, the projection 50 is located at a distal end portion of the outline curve 51*a* of the cam 51. When the support plate 48 is further rotated, the projection 50 is moved along the outline curve 51*a*. When the projection 50 is moved along the outline curve 51*a* as described above, a distance between the projection 50 and the shaft 35 is shortened. Namely, the spring 49 is contracted, so that the entire length of the support plate 48 is shortened.

By rotating the support plate 48 in the arrow direction in FIG. 9 as described above, the sheets S placed on the support plate 48 are dropped onto the placing tray 53. At this time, the rear ends of the sheets S are placed on the second placing section 53*b*, and the forward ends of the sheets S are placed on the first placing section 53*a*. After the support plate 48 allows the sheets S to drop onto the placing tray 53, the support plate 48 is rotated reversely to the arrow direction in FIG. 9 to be returned to the initial state. At this time, since the projection 50 is moved away from the shaft 35, the spring 49 is extended, so that the entire length of the support plate 48 is elongated.

According to the third embodiment, since the support plate 48 can be kept elongated in the initial state before the support plate 48 is rotated, the support plate 48 can securely support the sheets S. Also, since the sheets S can be placed on the placing tray 53 by merely rotating the support plate 48 from the initial state, it is not necessary to specially provide the placing tray outside the side surface of the image forming apparatus 1, so that the installation area can be reduced.

Also, in the support plate 48, as the support plate 48 is rotated, the length thereof is shortened. Thus, a space required for rotating the support plate 48 can be small. Accordingly, the sheet post-processing device FS can be made much more compact.

Further, as described above, since the support plate 48 is shortened in accordance with the rotation thereof, even if a large number of sheets S is placed on the placing tray 53, the rotated support plate 48 does not contact the sheets S. Therefore, much more sheets S can be placed on the placing tray 53.

In addition, since the spring 54 is disposed under the first placing section 53*a* of the placing tray 53, when the sheets S are placed on the first placing tray 53*a*, the spring 54 is contracted due to the weight of the placed sheets S. When the spring 54 is contracted, the first placing section 53*a* is rotated around the shaft 55. As described above, in accordance with an amount of the sheets S placed on the first placing section 53*a*, the first placing section 53*a* contracts the spring, so that the position of the first placing section 53*a* can be lowered.

By lowering the position of the first placing section 53*a* in accordance with the amount of the sheets S, even if the amount of placing the sheets S is increased, the rotation of the paddles 22 or the like is not prevented. Therefore, much more sheets S can be placed on the placing tray 53.

Figure 10:
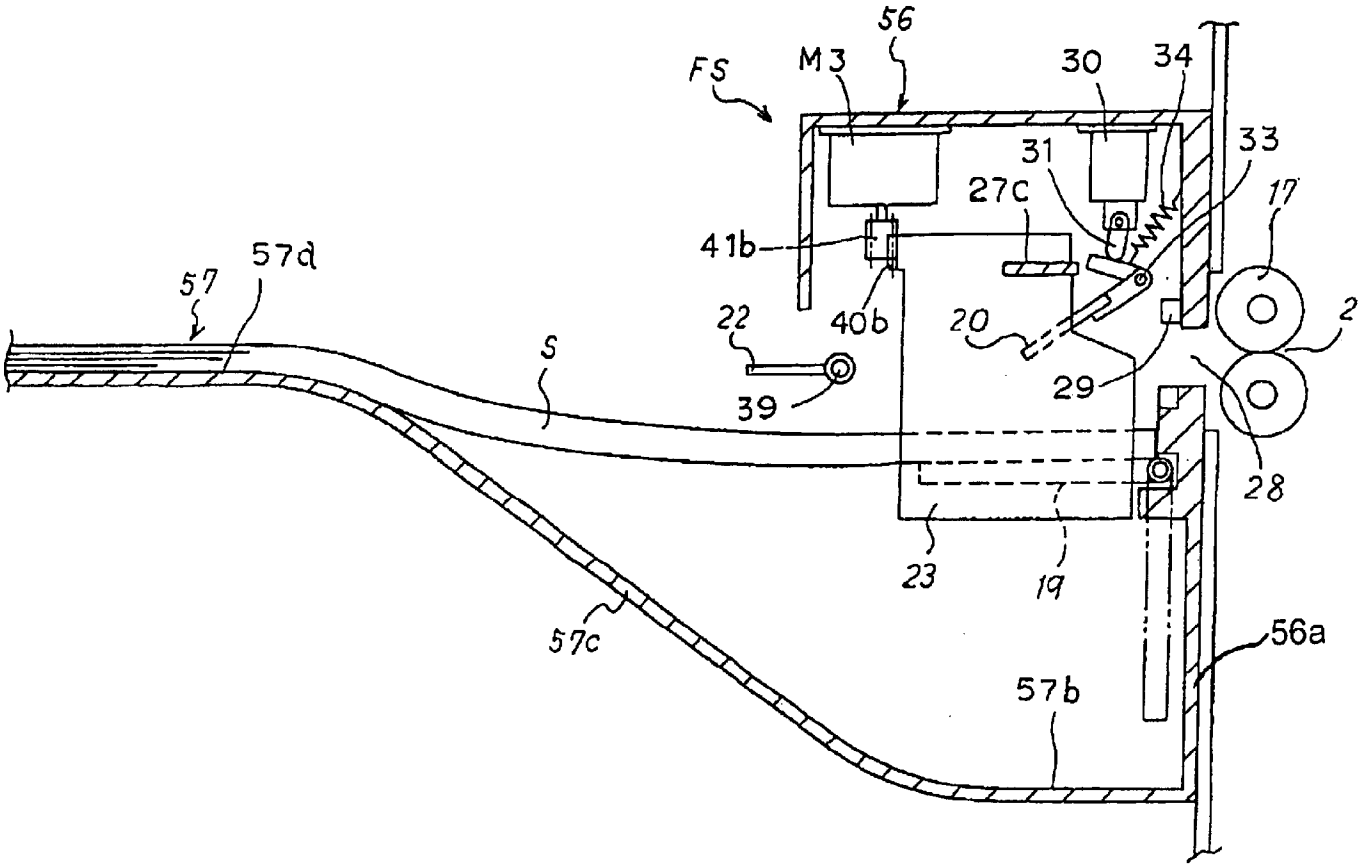
FIG. 10 is a schematic view showing a fourth embodiment of the invention.
Figure 11:
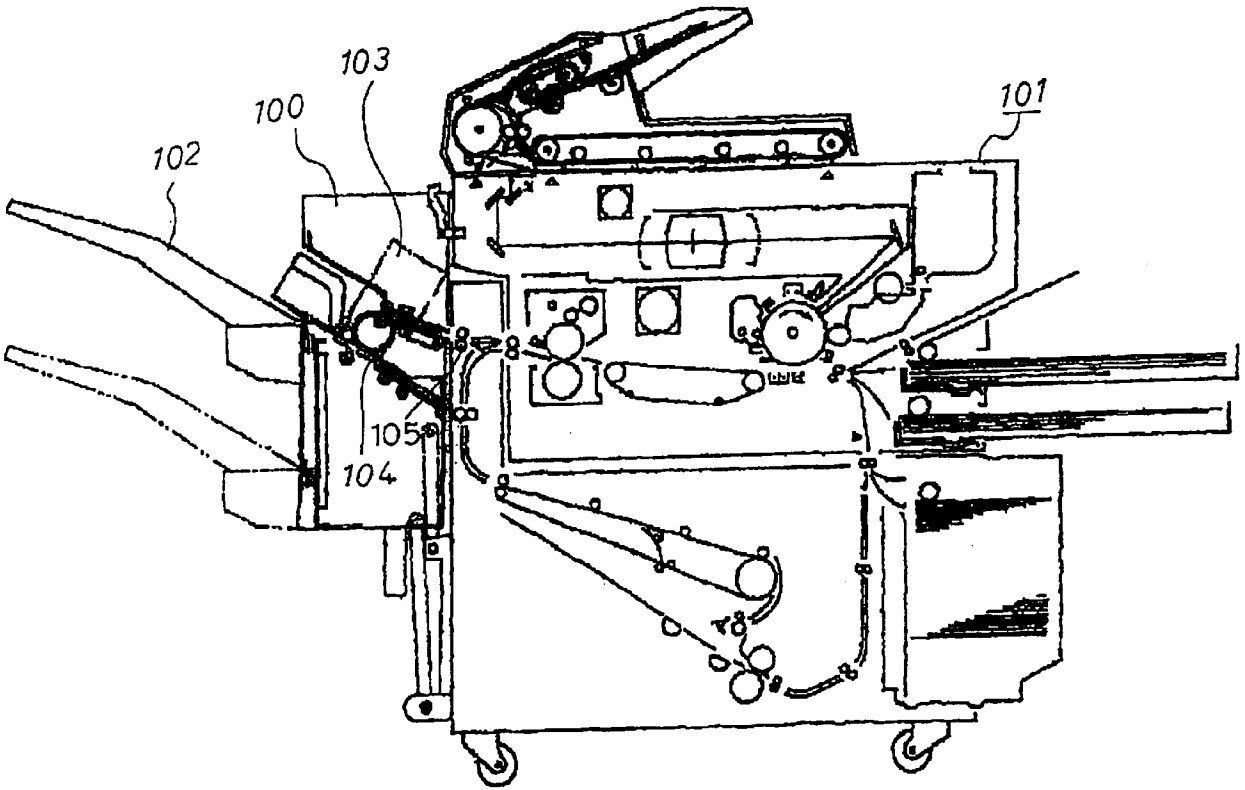
Fig. 11 Prior Art
FIG. 11 is a schematic view showing an example of a conventional image forming apparatus with a sheet post-processing device.
Figure 12:
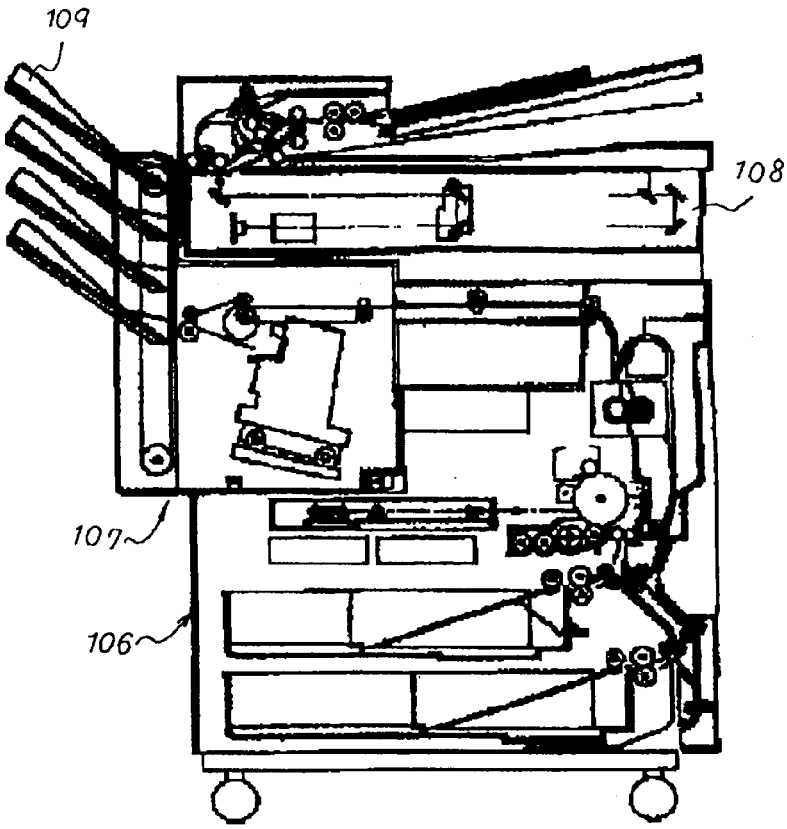
Fig. 12 Prior Art
FIG. 12 is a schematic view showing another example of a conventional image forming apparatus with a sheet post-processing device.
Figure 13:
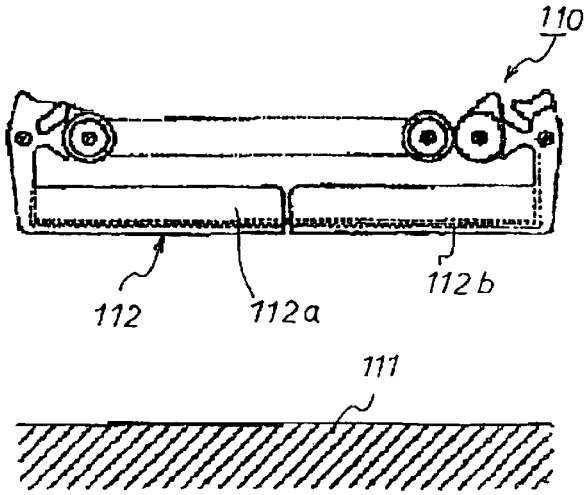
Fig. 13 Prior Art
FIG. 13 is a schematic view showing an example of a conventional sheet post-processing device.
Figure 14:
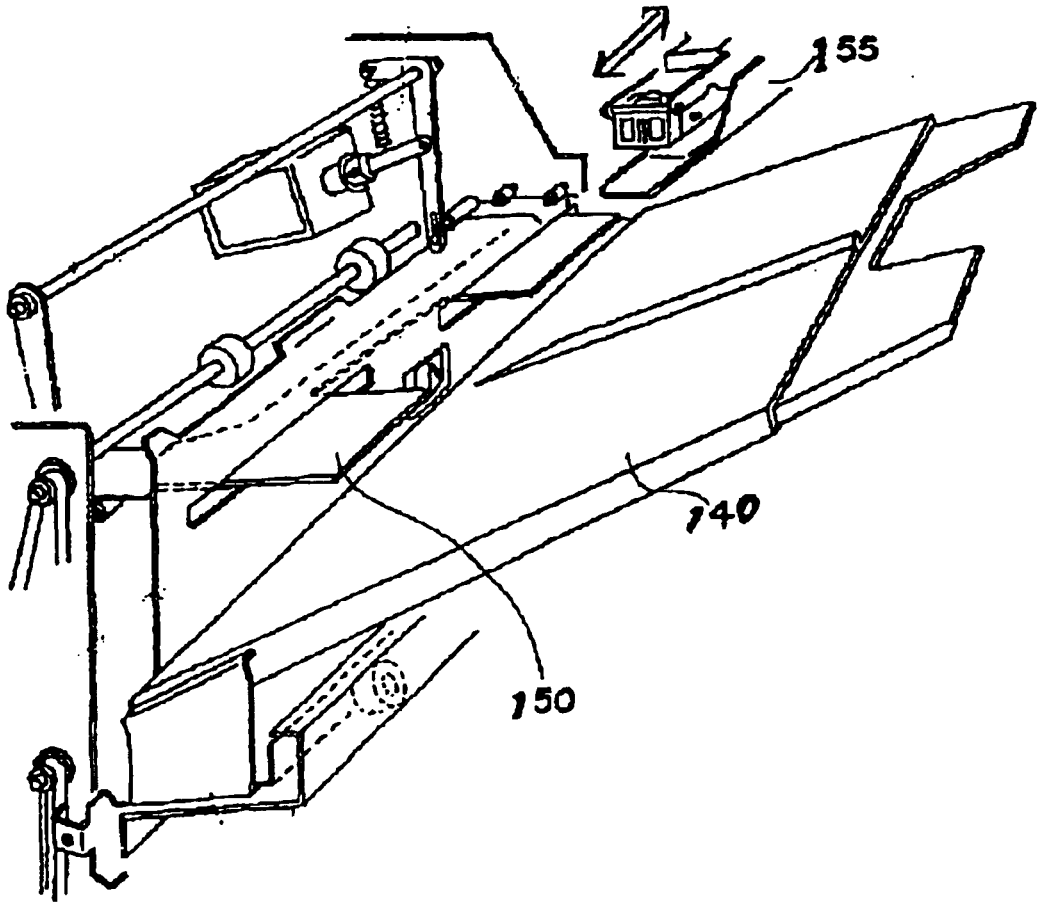
Fig. 14 Prior Art
FIG. 14 is a schematic view showing a part of still another example of a conventional image forming apparatus with a sheet post-processing device.

FIG. 10 shows a fourth embodiment, wherein the placing tray is integrally formed with the cover of the sheet post-processing device. Structures other than that are the same as those in the first embodiment. The constituents which are the same as those in the first embodiment are designated by the same references as in the first embodiment, so that the detailed explanations thereof are omitted herewith.

In the fourth embodiment, a placing tray section 57 is formed at a cover 56 of the sheet post-processing device FS. The placing tray section 57 includes a first placing section 57*a* and a second placing section 57*b*. The first placing section 57*a* is located at a position higher than that of the second placing section 57*b*, and the first placing section 57*a* and the second placing section 57*b* are connected through an inclined section 57*c*. It is desirable that the position of the first placing section 57*a* is at substantially the same height as that of the paper ejection port 2.

Also, an end portion of the second placing section 57*b*, which is opposite to the inclined section 57*c*, is connected to a side surface 56*a* of the cover 56. The second placing section 57*b* is located below the support plate 19, and positioned to have a distance from the support plate 19 such that the support plate 19 does not collide with the second placing section 57*b* even if the support plate 19 is rotated.

If the placing tray does not have a raised portion, such as the first placing section 57*a*, the sheet S ejected from the paper ejection port 2 is liable to be dropped from the support plate 19 due to its own weight. Namely, since the sheet is not placed on the support plate 19, the post-processing by the staple unit 26 is not carried out with respect to the sheet. Also, even if the sheet is placed on the support plate 19, the forward end portion of the sheet S in the transferring direction becomes heavy, so that the sheet S is not aligned neatly.

However, in the fourth embodiment of the invention, since the first placing section 57*a* and the second placing section 57*b* are provided in the sheet post-processing section FS, even in a image forming apparatus which does not have a first placing section, the beautiful post-processing of the sheet is made.

Further, according to the fourth embodiment, even in the image forming apparatus in which there is no slope in the placing tray, without providing a placing tray separately, the compact sheet post-processing device FS can be assembled therewith. Therefore, the entire image forming apparatus can be made compact.

As described above, according to the present invention, in the sheet post-processing device, supporting means for supporting the rear ends of the sheets to be post-processed is moved to a position of releasing the sheets in the dropping direction, and the sheet post-processing device includes means for shifting the sheets from the post-processing means. Thus, the sheet post-processing device can be made compact.

Further, according to the present invention, since the means for aligning the sheets supported on the supporting means is provided, post-processing in the state that the side edges of the sheets are aligned can be carried out. Also, since the shift means for moving the sheets may be also used as the aligning means, the structure can be simplified.

Further, since the supporting means is formed of freely rotatable supporting means, by merely rotating the supporting means, the sheets can be placed on the placing tray. Also, since the supporting means supports only the rear ends of the sheets, the size of the supporting means can be small, and it is not necessary to have a large space for rotating the supporting means. Therefore, the sheet post-processing device can be made much more compact.

In addition, since the supporting means may be capable of expanding and contracting freely, in accordance with the rotation of the supporting means, the supporting means can be contracted. Therefore, a, space for rotating the supporting means can be further reduced, and the entire sheet post-processing device can be made smaller. Even if the sheet post-processing device is assembled with the image forming apparatus, a height of the image forming apparatus as a whole is not increased. Since the height of the entire image forming apparatus is not increased, the image forming apparatus is used easily.

Also, an upper surface of the apparatus may constitute the placing tray, and the sheet post-processing device made into a unit may be provided between the placing tray and the ejection port of the image forming apparatus of a type including the sheet projection port projecting further above the placing tray. Thus, the sheet post-processing device can be assembled with the image forming apparatus without increasing an area for installing the image forming apparatus and a height thereof.

Also, the placing tray for placing the sheets is formed of a first placing section for supporting the forward end side in the transferring direction of the sheets supported by the supporting means, and a second placing section for supporting the rear end portions in the transferring direction of the sheets when the sheets are dropped, and the second placing section is set at a position lower than that of the first placing section. Therefore, before the sheets are dropped, the sheets can be securely supported by the supporting means and the first placing section, and when the sheets are going to drop, the sheets can be surely released from the supporting means.

Further, according to the present invention, the compact sheet post-processing device is provided between the image forming apparatus and the image reading device. Accordingly, it is not necessary to provide the sheet post-processing device outside the image forming apparatus, so that the image forming apparatus can be made smaller, and the installation area thereof can be reduced.

While the invention has been explained with reference to the specific embodiments of the invention, the explanation is illustrative and the invention is limited only by the appended claims.

What is claimed is:

1. An image forming apparatus comprising:

an image forming apparatus main body having an upper portion, and a sheet ejecting section with a sheet ejection port, a placing tray formed on the upper portion of the image forming apparatus main body and located under the sheet ejection portion to receive a sheet ejected from the image forming apparatus main body thereon, an image reading device for reading an image disposed above the sheet ejecting section to cover the placing tray, and a sheet post-processing unit disposed outside the sheet ejection port between the image reading device and the placing tray, and including supporting means capable of rotating between a support position for supporting an upstream side of an ejected sheet in a transfer direction and a retreat position for allowing the sheet to drop onto the placing tray, post-processing means disposed at a side adjacent to the supporting means for applying post-processing to the sheet supported on the supporting means, sheet shift means laterally moving the sheet into the post-processing means and moving the sheet after the post-processing outside the post-processing means, and means for transferring the sheet shift means disposed above the supporting means.

2. An image forming apparatus according to claim 1, wherein said placing tray on the upper portion of the image forming apparatus main body includes a first placing section for supporting a forward end of the sheet in the transferring direction and a second placing section located below the supporting means lower than the first placing section.

3. An image forming apparatus according to claim 1, wherein said image reading device further includes a main reading portion, and a sheet transferring device for automatically transferring a sheet to be read to the main reading portion.

4. An image forming apparatus according to claim 1, wherein said placing tray includes a movable placing section, and a spring disposed under the movable placing section so that the movable placing section is lowered by weight of sheets thereon.

5. An image forming apparatus according to claim 1, wherein said sheet ejection port is located at one side of the upper portion to face inside the main body, and the placing tray is interposed between the main body and the image reading device without extending outwardly from the main body.

6. An image forming apparatus comprising:

an image forming apparatus main body having an upper portion, and a sheet electing section with a sheet ejection port, a placing tray formed on the upper portion of the image forming apparatus main body and located under the sheet ejection portion to receive a sheet ejected from the image forming apparatus main body thereon, an image reading device for reading an image disposed above the sheet ejecting section to cover the placing tray, and a sheet post-processing unit disposed between the image reading device and the placing tray and detachably attached with respect to the sheet ejection port, said sheet post-processing unit including supporting means capable of moving between a support position for supporting an upstream side of a sheet ejected in a transfer direction and a retreat position for allowing the sheet to drop onto the placing tray located immediately under the supporting position, post-processing means disposed at a side adjacent to the supporting means for applying post-processing to the sheet supported on the supporting means, sheet shift means for moving the sheet into the post-processing means and setting the sheet therein, and means for transferring the sheet shift means.

7. An image forming apparatus according to claim 6, wherein said supporting means is arranged to rotate as a pivotal portion at an upstream side of the sheet in the transfer direction from the support position for supporting the sheet to the retreat position for dropping the sheet onto the placing tray immediately under the supporting position.

8. An image forming apparatus according to claim 6, wherein said sheet shift means is arranged such that the sheet shift means moves the sheet by pushing a side edge of the sheet supported on the supporting means, and said means for transferring the sheet shift means is disposed above the support means.

* * * * *